US008889604B2

(12) United States Patent
Lee et al.

(10) Patent No.: US 8,889,604 B2
(45) Date of Patent: Nov. 18, 2014

(54) METHOD OF PREPARING GREASES

(75) Inventors: David S. Lee, San Ramon, CA (US); Susan M. Abernathy, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 340 days.

(21) Appl. No.: 13/073,793

(22) Filed: Mar. 28, 2011

(65) Prior Publication Data

US 2012/0028860 A1 Feb. 2, 2012

Related U.S. Application Data

(63) Continuation-in-part of application No. 12/847,072, filed on Jul. 30, 2010.

(51) Int. Cl.
*C10M 177/00* (2006.01)
*C10M 133/20* (2006.01)

(52) U.S. Cl.
CPC ..... *C10M 177/00* (2013.01); *C10N 2250/10* (2013.01); *C10M 2203/1006* (2013.01); *C10M 2207/123* (2013.01); *C10M 2207/125* (2013.01); *C10M 2207/127* (2013.01); *C10M 2207/144* (2013.01); *C10M 2215/1026* (2013.01); *C10N 2210/01* (2013.01); *C10N 2210/02* (2013.01); *C10N 2210/03* (2013.01); *C10N 2220/021* (2013.01); *C10N 2270/00* (2013.01)
USPC ..... 508/110; 508/528; 264/328.6

(58) Field of Classification Search
USPC ..... 508/386, 110, 528; 264/328.6
See application file for complete search history.

(56) References Cited

U.S. PATENT DOCUMENTS

| | | | | |
|---|---|---|---|---|
| 3,243,372 | A | 3/1966 | Dreher et al. | |
| 3,983,041 | A * | 9/1976 | Abbott | 508/528 |
| 4,436,649 | A | 3/1984 | Stemke | |
| 4,469,130 | A * | 9/1984 | James et al. | 137/606 |
| 4,661,276 | A | 4/1987 | Stemke | |
| 4,668,411 | A | 5/1987 | Yasui et al. | |
| 4,692,255 | A | 9/1987 | Matzat et al. | |
| 4,780,231 | A | 10/1988 | Kinoshita et al. | |
| 5,314,982 | A | 5/1994 | Rasp et al. | |
| 5,554,586 | A | 9/1996 | Pratt | |
| 5,614,481 | A | 3/1997 | Lopez Rangel | |
| 6,063,743 | A | 5/2000 | Seubert et al. | |

(Continued)

FOREIGN PATENT DOCUMENTS

| | | | |
|---|---|---|---|
| JP | 03190996 A * | 8/1991 | |
| JP | Hei 3 (1991)-190996 | 8/1991 | |
| WO | WO 02/04579 A1 | 1/2002 | |

*Primary Examiner* — James Goloboy
(74) *Attorney, Agent, or Firm* — E. Joseph Gess; Melissa M. Hayworth; Steven H. Roth

(57) ABSTRACT

Provided is a method for preparing a grease composition, which comprises mixing grease components under high pressure and high flow rate impingement. In one embodiment, a first mixture of an amine in a lubricating base oil is mixed with an isocyanate in a lubricating base oil under high pressure and high flow impingement. In another embodiment, the mixing and reaction occurs in a reaction injection molding device. The orifice size through which each of the mixtures is introduced into a reaction/mixing zone is less than 0.030 inch (0.0762 centimeter) in diameter. The resulting grease composition is an extremely low noise grease, being virtually clear of any urea thickener particles, and/or can exhibit good high temperature resistance and mechanical stability.

18 Claims, 4 Drawing Sheets

Microscope picture of grease made using RIM method at 2500 PSI shot pressure.

(56) References Cited

U.S. PATENT DOCUMENTS

| | | | |
|---|---|---|---|
| 6,136,762 | A | 10/2000 | Yoshinari et al. |
| 6,407,043 | B1 | 6/2002 | Moehr |
| 6,498,130 | B2 | 12/2002 | Baum |
| 6,916,768 | B2 | 7/2005 | Ward et al. |
| 7,111,989 | B1 | 9/2006 | Cook et al. |
| 7,550,415 | B2 | 6/2009 | Fuijitsu et al. |
| 2006/0052261 | A1 | 3/2006 | Kray et al. |
| 2007/0203036 | A1 | 8/2007 | Baum |

* cited by examiner

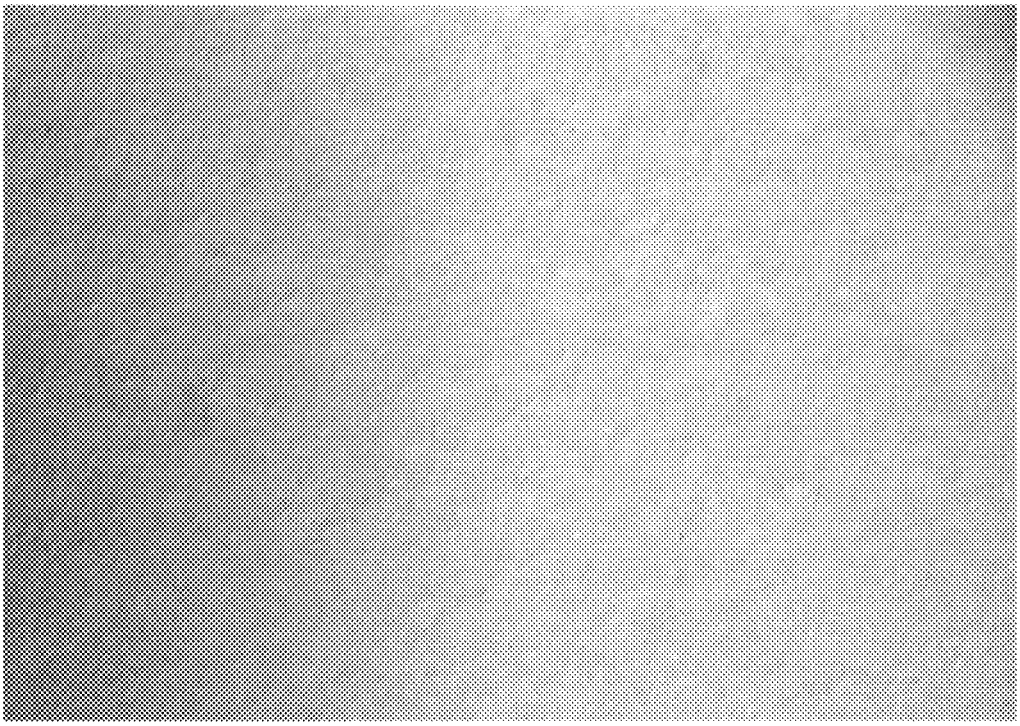
Fig 1. Microscope picture of grease made using RIM method at 2500 PSI shut pressure.

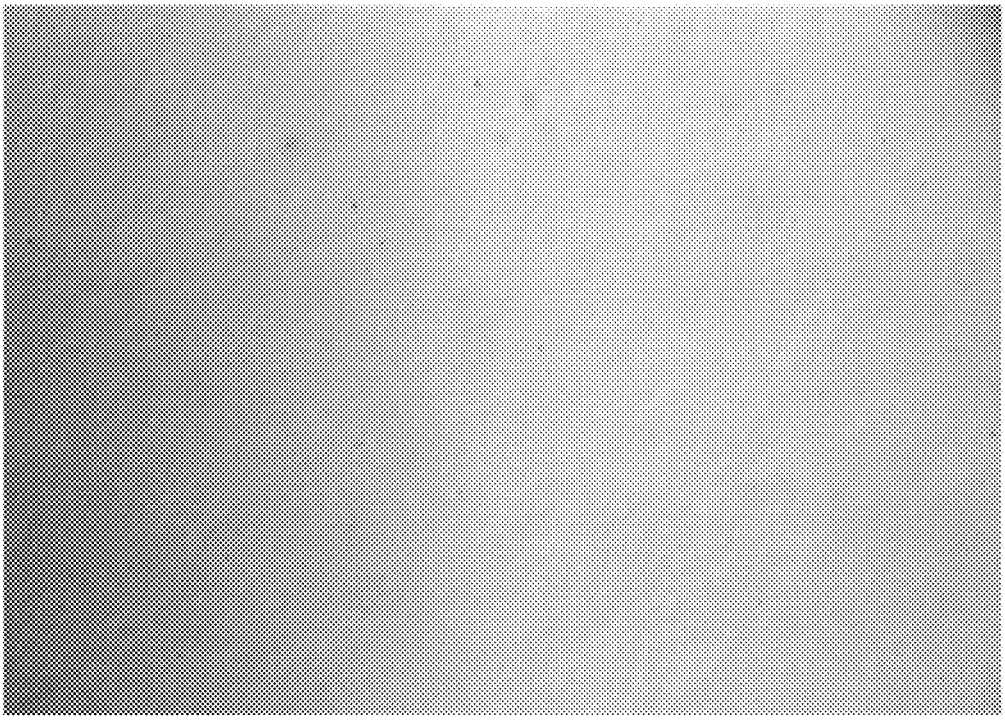
Fig 2. Microscope picture of grease made using RIM method at 1700 PSI shot pressure.

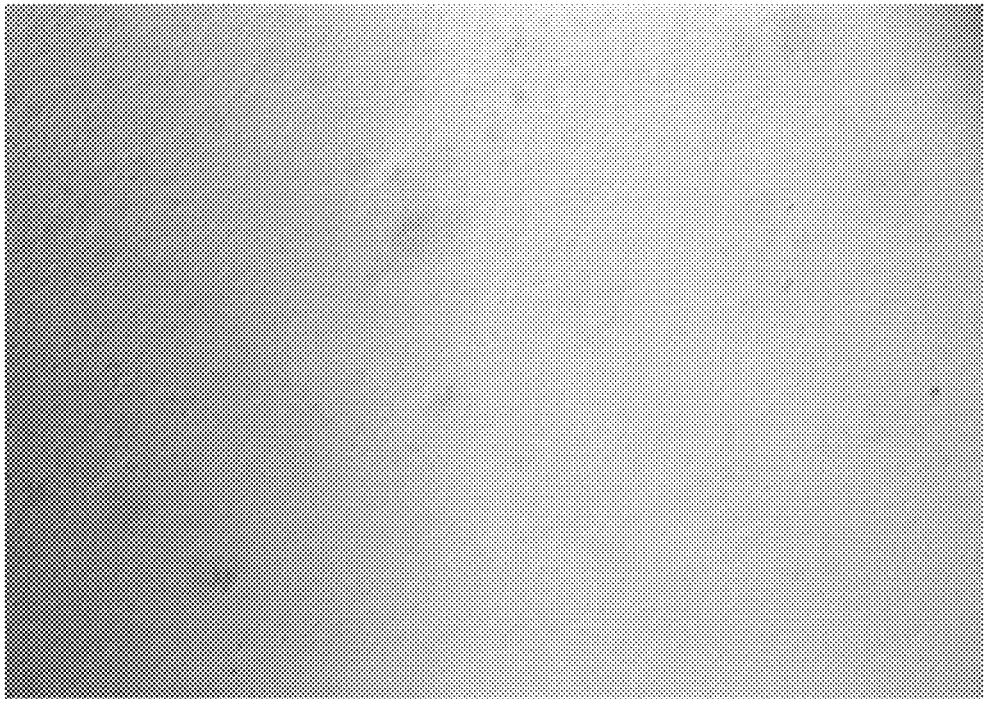
Fig 3. Microscope picture of grease made using RIM method at 1000 PSI shot pressure.

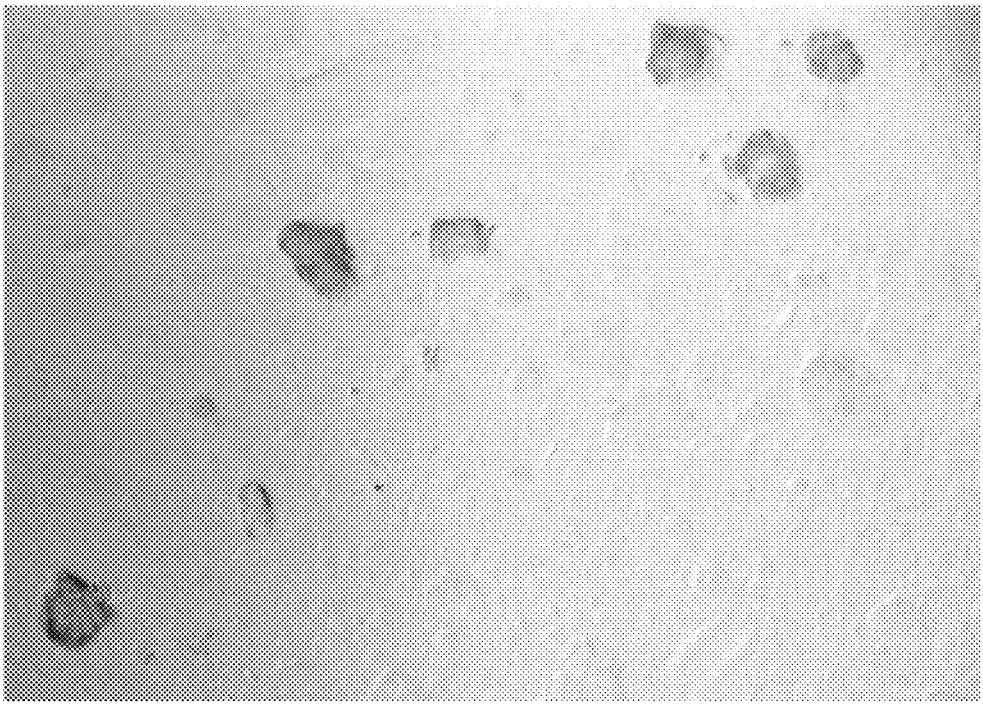
Fig 4. Microscope picture of grease made using conventional laboratory methods.

METHOD OF PREPARING GREASES

CROSS REFERENCE TO RELATED APPLICATIONS

The present application is a continuation-in-part of U.S. application Ser. No. 12/847,072, filed Jul. 30, 2010, the entirety of which is hereby incorporated by reference.

BACKGROUND

1. Technical Field

We provide a method of preparing greases, and in one embodiment greases thickened with thickeners having urea functional groups. In one embodiment, the present invention relates to a method of preparing greases using high pressure and high flow rate impingement for effecting the simultaneous mixing of the grease and reaction to form the thickeners.

2. Description of the Related Art

Grease manufacturing technologies have not changed significantly over the last decade. The current capabilities center around the use of standard kettle procedures, batch processing, and continuous grease manufacturing methods used for lithium and lithium complex greases. New manufacturing techniques for greases to help reduce the complexity of synthesis of grease formulas are needed. More effective and efficient manufacturing processes are always desired, particularly if the new process also imparts desired physical properties into the grease formulas. One such important property is "noise", with others being mechanical stability and high temperature resistance.

The quiet running properties (noise) of greases used to lubricate deep groove ball bearings have become increasingly important to bearing manufacturers in their selection of factory fill greases. Historically, bearing manufacturers became increasingly concerned about bearing vibration that manifested itself as audible sound as the demand grew for quieter machines. As bearings were machined to finer tolerances, becoming inherently less noisy, the noise contributions of the greases used to lubricate them became increasingly apparent. Consequently, the major bearing manufacturers independently developed instrumentation that allowed measurement of the contribution of grease to bearing noise. In addition, correlation of bearing life to the presence of contaminants promoted an even greater concern with grease noise testing because the assumption is often made that grease noise always correlates to the presence of contaminants and therefore with shortened bearing life. Although most grease manufacturers would agree that knowing the noise characteristics of a grease does not provide sufficient information to allow prediction of the life of a bearing lubricated with it, noise testing is nonetheless increasingly used to assess the overall quality of ball bearing greases. Grease manufacturers therefore must be concerned with the noise quality of their products and with the various methods by which grease noise quality is determined if they are to continue to supply greases to the bearing manufacturing industry.

Although grease noise testing has been the subject of numerous publications over the past twenty-six years, no standard test instrument, test bearing, or test protocol has been adopted by either grease suppliers or bearing manufacturers during this time. In fact, a wide variety of proprietary grease noise testing methods is currently in use, particularly in the bearing manufacturing industry, where each major bearing manufacturer has developed its own proprietary instrumentation and methods. In addition, each method is considered by its proponents to provide a competitive edge for the company that uses it.

Because of the above considerations, testing the quiet running (noise) properties of grease has been an issue. Originally, a manual test was developed which allowed assessment of the running properties of a batch of grease by the feel of a bearing packed with it. As the noise quality of bearings themselves improved, it became necessary to be able to detect lower and lower levels of bearing vibration. As a result, Chevron Research (Richmond, Calif.) began using a modified bearing vibration level tester (an anderonmeter) to test for grease noise and began carefully studying the effects of additives and processing variables on grease noise. The anderonmeter, which was originally developed to assess bearing vibrational quality, measures the radial displacement of the outer race of a bearing as a function of its rotation. In fact, the name anderon is an acronym for "angular derivative of the radial displacement". In physical terms, the anderon is expressed as displacement distance/unit rotation:

The sensor head, which is in contact with the outer race, detects bearing vibration. The sensor signals are amplified and filtered into three frequency bands which span the range of audible sound frequencies:

Low: 50-300 Hz

Medium: 300-1,800 Hz

High: 1,800-10,000 Hz.

Vibration (noise) due to grease can be detected in the medium and high frequency bands. In the earliest version of the Chevron grease noise test, the highest recorded vibrational spike recorded in the medium band during a one-minute run was averaged for five bearings and the average reported as the grease anderon value.

Chevron later refined its test instrument, adding noise pulse counting capability. The pulse counter allows the detection of transients, which are too fast to be recorded on the strip chart recorder. During a test the signal level in each band is displayed on a corresponding meter and is recorded on a strip chart recorder, while the pulse counter detects and displays a figure proportional to the number of vibrational transients that occur above a preset threshold amplitude level. At the end of each test run, the medium band pulse counter reading is noted and the strip chart record of the medium band signal is examined. The first five seconds on the chart are disregarded as start-up noise and the highest amplitude peak (spike) anderon value recorded during the remaining 55 seconds is noted. The noted results for five bearings are averaged and reported as anderon spike value/pulse count.

Different grease compositions have an impact on the amount of bearing vibration and audible noise. Grease noise is attributed to the presence of particles in grease. There are process techniques to help control the particle size during grease manufacture, but better techniques to further improve the noise properties is still desired.

High temperature resistance of a lubricating grease can be determined by its dropping point. The dropping point of a grease is generally measured, for example, by standard test method ASTM D 2265-06. The dropping point of a lubricating grease is the temperature at which the thickener can no longer hold the base oil. Some of the reasons the lubricating base oil can no longer be held are that the oil has become so thin it is not held by the thickener, or the thickener has melted. In testing, the grease is generally placed in a cup and heated. The dropping point is the temperature when the first drop of oil falls from a lower opening in the cup. This characteristic is very important for greases to be subjected to high temperature environments.

The mechanical stability characteristics of a grease are also important. Mechanical stability provides information on the ability of the grease to withstand changes in consistency during continued mechanical working. The standard test method used to measure mechanical stability is ASTM D 217-10. Penetration values at unworked P(0), 60 strokes P(60) and 100,000 strokes P(100,000) provide a good insight as to the mechanical stability of a grease.

The search continues for new effective and efficient manufacturing processes for greases. Particular benefits would be realized if such a process also produces a low noise grease, or a grease exhibiting good high temperature resistance and mechanical stability, for example, a polyurea type grease.

SUMMARY

Provided is a method for preparing a grease composition, which comprises mixing together the components of a grease under high pressure and high flow rate impingement. Impingement involves forcing streams of reagents toward one another at high flow rates, producing very thorough mixing. The mixing chamber into which the streams of reagents are forced will have orifice sizes of less than 0.030 inch (0.0762 centimeter) in diameter, and typically on the order of 0.020 inch (0.0508 centimeter) in diameter or less. The residence time for mixing is generally ten seconds or less, with complete reaction to form the thickener. In one embodiment, the residence time is one second or less. Therefore, the process is quite efficient. The method for preparing grease can be batchwise, or part of a continuous grease manufacturing unit. The use of the high pressure and high flow rate impingement together with the small orifice sizes also results in a near complete reaction and dispersion of the thickener throughout the grease. The dispersion is definitely more effective than that obtained in traditional batch methods.

In one embodiment, the mixing and reaction occurs in a reaction injection molding device. The resulting grease composition is an extremely low noise grease, being virtually clear of any urea thickener particles.

In one embodiment, an amine/lubricating base oil mixture is mixed with an isocyanate/lubricating base oil mixture in accordance with the present process. The result is complete reaction to form a urea based thickener which is completely dispersed throughout the grease product.

Among other factors, it has been discovered that when a high pressure/high flow rate impingement procedure for mixing and reacting thickener reactants, e.g., an amine and isocyanate, in a lubricating base oil, is used with entry orifices of less than 0.030 inch (0.0762 centimeter) in diameter to a mixing chamber, a base grease product is obtained efficiently and effectively. Generally, a reaction injection molding device can be used. The mixing/reaction time is very short, ten seconds or less, and in one embodiment, one second or less, allowing for a highly efficient process with a large amount of product being prepared in a short period of time. The product obtained is a base grease with outstanding noise properties, and/or good high temperature resistance and improved mechanical stability, speaking to the effectiveness of the process. Simultaneously, the thickener, e.g., urea thickener, is prepared through a reaction of the thickener reactants, e.g., amine and isocyanate, and the thickener is dispersed throughout the lubricating base oil to create the base grease. The dispersion is so effective that further processing or milling of the grease is generally not needed.

BRIEF DESCRIPTION OF THE FIGURES OF THE DRAWINGS

FIG. 1. Microscope picture of grease made using RIM method at 2500 PSI (1.724e+007 newtons/square meter) shot pressure.

FIG. 2. Microscope picture of grease made using RIM method at 1700 PSI (1.172e+007 newtons/square meter) shot pressure.

FIG. 3. Microscope picture of grease made using RIM method at 1000 PSI (6.895e+006 newtons/square meter) shot pressure.

FIG. 4. Microscope picture of grease made using conventional laboratory methods.

DETAILED DESCRIPTION OF THE EMBODIMENTS

In one embodiment, we provide a method for preparing greases, which greases have low noise characteristics, and/or high temperature resistance and improved mechanical stability. The process comprises mixing together the components of a grease, which includes reactants that react to form the thickener and a lubricant base oil, under high pressure and high flow rate impingement conditions. The pressure can range broadly from 500-8000 psi (3.447e+006-5.516e+007 newtons/square meter). In one embodiment, the pressure can range from 500-4000 psi (3.447e+006-2.758e+007 newtons/square meter), in another embodiment from 1000-3500 psi (6.895e+006-2.413e+007 newtons/square meter), or 1200-3000 psi (8.274e+006-2.068e+007 newtons/square meter). The high flow rate impingement is such that the reactant solutions are mixed together at a rate of 5 to 1000 g (0.1764 to 35.27 ounce)/sec. In general, the residence time in the reaction chamber, i.e., the mixing time, is often less than 10 seconds, and in one embodiment less than 1.0 second. Other embodiments employ a residence or mixing time of less than 0.5, and often less than 0.3 seconds. The orifices for entry into the reaction chamber are less than 0.030 inch (0.0762 centimeter) in diameter, and are typically less than 0.020 inch (0.0508 centimeter) in diameter. It has been found that the use of such small orifices provides higher mixing pressures, and has been found to result in better mixing, reaction and homogeneity of the grease. Different orifices, having different sizes, can be used for the various mixtures.

In one embodiment, the reaction and mixing occurs in a reaction injection molding device (RIM). Such devices are well known, and offer the ability to have two solutions collide and mix under high pressure, high flow rate impingement conditions.

The process involves simultaneous mixing and reaction with dispersion of the reaction product. The intimate mixing of the thickener reactants results in a reaction to form the thickener. The thickener is uniformly dispersed throughout the lubricating base oil to create a base grease product. No particles are generally seen under 200× magnification. This base grease can be a concentrate, containing 20% by weight or more of the urea thickener, for example, from 20 to 50 wt %. As a concentrate, it is easier to work with in preparing the ultimate grease product or ship it to where the ultimate product is prepared. The final grease product can comprise from 0.5-25 wt % thickener, or from 11-14 wt %. Using a concentrate of 20% thickener or more would simply involve adjusting the amount of lubricating base oil, and mixing, to obtain the desired consistency.

In making the grease, at least two mixtures are created and mixed. Each mixture comprises one of the thickener reactants and lubricating base oil. For example, in preparing a urea grease, the first mixture is an amine mixture comprised of a lubricating base oil and at least one amine. More than one amine can be used. Any appropriate amine or mixtures of amines can be used in preparing the urea thickener. The amount of amine in the amine/lubricating base oil mixture is generally from 5 to 30 wt % of the mixture. The second mixture is comprised of a lubricating base oil and at least one isocyanate. More than one isocyanate can be used. Any appropriate isocyanate compound, or mixture of compounds, can be used as appropriate in preparing the urea thickener. The amount of isocyanate in the isocyanate/lubricating base oil mixture is generally in the range of from about 5 to 30 wt % of the mixture.

The two mixtures containing the thickener reactants and the lubricating base oil of the grease are then sent to a reaction chamber, such as in a reaction injection molding (RIM) device, under high pressure and high flow rate impingement conditions. The orifices used for entry of each of the mixtures are less than 0.030 inch (0.0762 centimeter) in diameter, and in one embodiment, less than 0.020 inch (0.0508 centimeter) in diameter. The orifices can be the same size or of different sizes. The thickener reactants react to form a thickener, which is dispersed effectively throughout the grease. The reaction and dispersion occur nearly simultaneously, and is generally so complete that further treatment is unnecessary.

Microscope images of the greases prepared with the present process show a smooth grease with no large pieces of thickener material. Generally, the present greases have little to no particles seen up to 200× magnification. Thus, while providing a very effective and efficient process for preparing the grease, an improved grease that has low noise characteristics is also obtained.

Noise characteristics are often measured in anderons. Anderons, recorded in microinches/radian, correspond to the detection of radial displacement of the outer race of a bearing as a function of its rotation. The anderon value is measured using a bearing vibration level tester, or anderonmeter, such as that manufactured by Sugawara Laboratories. This is the standard instrument used for bearing noise testing. In the test, the highest recorded vibrational spike value recorded in the medium band (i.e., 300-1,800 Hz) is recorded during a one-minute run for five bearings, with the first 5 seconds of each one-minute run being disregarded. More than one run is performed, and the highest values (i.e., the most noisy events) for each run are averaged and reported as the anderon value. The present greases generally do not record a spike higher than 4 anderons.

The present greases can also exhibit excellent high temperature resistance as measured by its dropping point. The dropping point of greases prepared by the present process are often greater than 500° F. (260° C.), and in another embodiment, greater than 530° F. (276° C.).

The mechanical stability of the greases prepared has also been found to be improved. This characteristic can be seen in the worked penetration value of the grease, particularly P(100,000). This worked penetration value P(100,000) can be 350 penetration points or less. A minimal change in penetration value from P(60) to P(100,000) is also telling of good mechanical properties. The present prepared greases can exhibit a change in penetration value from P(60) to P(100,000) of 100 penetration points or less, or in another embodiment, 60 penetration points or less.

The components of the grease to be mixed include reactants that react to form the thickener, and a lubricant base oil. As discussed above, the reactants to form the thickener are included in different mixtures comprising at least one reactant and lubricant base oil. The thickener types that are made include simple soap, complex soap, polyurea, polydimethylsiloxane, polypropylene, and other polymers. Soap greases are formed by saponification reactions and they are currently greater than 90% of all greases manufactured. For simple soap thickener the reactants comprise metal hydroxide and one or more fats. For complex soap thickener the reactants additionally include a short chain acid that functions as a complexing agent, such as for example salicylic acid, azaleic acid, or sebacic acid. Examples of metal hydroxides are lithium hydroxide, calcium hydroxide, sodium hydroxide, barium hydroxide, and aluminum hydroxide. The metal hydroxide can also be a mixture, such as a mixture of calcium hydroxide and lithium hydroxide. The fats are typically fatty acids or fatty esters, such as methyl esters or triglycerides. Examples of suitable fatty acids are stearic acid, oleic acid, and linoleic acid. The fats can be vegetable or animal in origin. For polyurea grease the reactants that react to form the thickener comprise an amine and an isocyanate.

In one embodiment, amines and isocyanate compounds are used in order to prepare a polyurea thickener. Examples of specific amines and isocyanate compounds are provided below. The following definitions will be used in describing the compounds:

"Alkylamine" refers to an amine $NH_2R$ wherein R is a linear saturated monovalent hydrocarbon group of one (1) to thirty five (35) carbon atoms, such as from six (6) to twenty five (25) carbon atoms, or a branched saturated monovalent hydrocarbon radical of three to thirty carbon atoms. Examples of alkylamines include, but are not limited to, pentylamine, hexylamine, heptylamine, octylamine, decylamine, dodecylamine, tetradecylamine, hexadecylamine, octadecylamine and the like.

"Alkenylamine" refers to an amine $NH_2R$ wherein R is a linear unsaturated monovalent hydrocarbon group of two (2) to thirty five (35) carbon atoms, such as from two (2) to twenty five (25) carbon atoms, or a branched unsaturated monovalent hydrocarbon group of three to thirty carbon atoms, wherein the linear unsaturated monovalent hydrocarbon group and the branched unsaturated monovalent hydrocarbon group contains at least one double bond, (—C═C—). Examples of alkenylamines include, but are not limited to, allylamine, 2-butenylamine, 2-propenylamine, 3-pentenylaime, oleylamine, dodeneylamine, hexadecenylamine and the like.

"Alkylenediamine" refers to a diamine $NH_2$—R—$NH_2$ wherein R is a linear saturated divalent hydrocarbon group of one (1) to thirty five (35) carbon atoms, such as from two (2) to twenty five (25) carbon atoms, or a branched saturated divalent hydrocarbon group of three (3) to thirty carbon (35) atoms. Examples of alkylenediamines include, but are not limited to, ethylenediamine, propylenediamine, butylenediamine, hexylenediamine, dodecylenediamine, octylenediamine, and the like.

"Polyoxyalkylenediamine" refers to a diamine $NH_2$—R—$NH_2$ wherein R is a polyoxyalkylene group. A polyoxyalkylene is a divalent repeating ether group of two (2) to thirty five (35) carbon atoms, such as from two (2) to twenty five (25) carbon atoms. Examples of polyoxyalkylenediamines include, but are not limited to, polyoxypropylenediamine, polyoxyethylenediamine, and the like.

"Cycloalkylenediamine" refers to a cycloalkyl group in which two (2) carbon atoms of the cycloalkyl are substituted with an amino group (—$NH_2$). "Cycloalkyl group" refers to a cyclic saturated hydrocarbon group of 3 to 10 ring atoms. Representative examples of cycloalkylenediamine groups include, but are not limited to, cyclopropanediamine, cyclohexanediamine, cyclopentanediamine, and the like.

"Cycloalkylamine" refers to a cycloalkyl group in which one (1) carbon atom of the cycloalkyl is substituted with an amino group (—$NH_2$). "Cycloalkyl group" refers to a cyclic saturated hydrocarbon group of 3 to 10 ring atoms. Representative examples of cycloalkylamine groups include, but are not limited to, cyclopropylamine, cyclohexylamine, cyclopentylamine, cycloheptylamine, and cyclooctylamine, and the like.

"Aryl-containing di-isocyanate" refers to a di-isocyanate containing an aryl functionality. "Aryl" refers to a monovalent monocyclic or bicyclic aromatic carbocyclic group of 6 to 14 ring atoms. Examples include, but are not limited to, phenyl, toluenyl, naphthyl, and anthryl. The aryl ring can be optionally fused to a 5-, 6-, or 7-membered monocyclic non-aromatic ring optionally containing 1 or 2 heteroatoms independently selected from oxygen, nitrogen, or sulfur, the remaining ring atoms being carbon where one or two carbon atoms are optionally replaced by a carbonyl. Representative aryl groups with fused rings include, but are not limited to, 2,5-dihydro-benzo[b]oxepine, 2,3-dihydrobenzo[1,4]dioxane, chroman, isochroman, 2,3-dihydrobenzofuran, 1,3-dihydroisobenzofuran, benzo[1,3]dioxole, 1,2,3,4-tetrahydroisoquinoline, 1,2,3,4-tetrahydroquinoline, 2,3-dihydro-1H-indole, 2,3-dihydro1H-isoindle, benzimidazole-2-one, 2H-benzoxazol-2-one, and the like. The aryl can also be optionally substituted with one to three substituents selected from the group consisting of alkyl, alkenyl, alkynyl, halo, alkoxy, acyloxy, amino, hydroxyl, carboxy, cyano, nitro, and thioalkyl. The aryl ring can be optionally fused to a 5-, 6-, or 7-membered monocyclic non-aromatic ring optionally containing 1 or 2 heteroatoms independently selected from oxygen, nitrogen, or sulfur, the remaining ring atoms being carbon where one or two carbon atoms are optionally replaced by a carbonyl. Examples of aryl-containing di-isocyanate include, but are not limited to, toluene di-isocyanate, methylenebis(phenylisocyanate), phenylenediisocyanate, bis (diphenylisocyanate), and the like.

"Alkyldiisocyanate" refers to a di-isocyanate containing an alkyl functionality. "Alkyl" refers to a linear saturated monovalent hydrocarbon group of one (1) to thirty five (35) carbon atoms, such as from six (6) to twenty five (25) carbon atoms, or a branched saturated monovalent hydrocarbon radical of three to thirty carbon atoms. Examples of alkyldiisocyanates include, but are not limited to, hexanediisocyanate, and the like.

Di-isocyanate refers to a compound containing two isocyanate groups, (O═C═N—).

Polyisocyanate refers to a compound containing more than two isocyanates groups (O═C═N—).

Polyurea refers to a compound containing two or more urea groups.

Among the amine compounds to be used are an alkylamine or alkenylamine; an alkylenediamine, polyoxyalkylenediamine, or cycloalkylenediamine; and a cycloalkylamine.

Examples of the alkylamine and alkenylamine to be used include, but are not limited to, pentylamine, hexylamine, heptylamine, octylamine, decylamine, dodecylamine, tetradecylamine, hexadecylamine, octadecylamine, oleylamine, dodecenylamine, and hexadecenylamine.

Examples of the alkylenediamine, polyoxyalkylenediamine, or cycloalkylenediamine to be used include, but are not limited to, ethylenediamine, propylenediamine, butylenediamine, hexylenediamine, dodecylenediamine, octylenediamine, polyoxypropylenediamine, and cyclohexanediamine.

Examples of the cycloalkylamine to be used include, but are not limited to, cyclopentylamine, cyclohexylamine, cycloheptylamine, and cyclooctylamine.

The isocyanate that can be used can be any appropriate isocyanate for making a diurea or polyurea upon reaction with the foregoing amines Examples of the aryl-containing-diisocyante or alkyldiisocyanate to be used include, but are not limited to, hexanediisocyanate, methylenebis(phenylisocyanate), phenylenediisocyanate, methylane diphenyl di-isocyanate and bis(diphenylisocyanate).

In one specific embodiment, the compounds to be used are toluene di-isocyanate (approximately 80% 2,4 isomer and 20% 2,6 isomer) (1), as the isocyanate compound; and oleylamine (9-octadecen-1-amine) (2), ethylenediamine (3), and cyclohexylamine (4) as a mixture of amine compounds.

Toluene di-isocyanate (1) (CAS Number: 26471-62-5) is commercially available from vendors such as Bayer (Pittsburgh, Pa.) and Dow Chemical (Midland, Mich.). Toluene di-isocyanate is used in such industries as adhesives coatings manufacturing, elastomer manufacturing, and flexible and rigid foam manufacturing, and is used in solvent-thinned interior clear finishes and synthetic resin and rubber adhesives.

The toluene di-isocyanate can be a mixture of isomers. In one embodiment, the mixture will be comprised of approximately 80% 2,4 isomer and 20% 2,6 isomer.

Oleylamine (2) (CAS Number: 112-90-3) is commercially available from vendors such as Akzo-Novel (Chicago, Ill.). Oleylamine can be used as a corrosion inhibitor, and is used in aerosol hairspray.

Ethylenediamine (3) (CAS Number: 107-15-3) is commercially available from vendors such as Dow Chemical (Midland, Mich.). Ethylenediamine is used in such industries as printed circuit board manufacturing, can be used as a corrosion inhibitor, an intermediate flux in welding or soldering, a complexing agent, or a process regulator for polyalkene glycols and polyether polyols, and is used in paint and varnish removers.

Cyclohexylamine (4) (CAS Number: 108-91-8) is commercially available from vendors such as J. T. Baker (Phillipsburg, N.J.). Cyclohexylamine can be used as a corrosion inhibitor.

In another specific embodiment, the isocyanate compound used is methylene diphenyl disocyanate, and a mixture of amines.

The lubricant base oil used can be selected from Group I, II, III, IV, and V lubricant base oils, and mixtures thereof. The lubricant base oils include synthetic lubricant base oils, such as Fischer-Tropsch derived lubricant base oils, and mixtures of lubricant base oils that are not synthetics and synthetics. The specifications for Lubricant Base Oils defined in the API Interchange Guidelines (API Publication 1509) using sulfur content, saturates content, and viscosity index, are shown below in Table I:

TABLE I

| Group | Sulfur, ppm | | Saturates, % | VI |
|---|---|---|---|---|
| I | >300 | And/or | <90 | 80-120 |
| II | ≤300 | And | ≥90 | 80-120 |
| III | ≤300 | And | ≥90 | >120 |
| IV | All Polyalphaolefins | | | |
| V | All Stocks Not Included in Groups I-IV | | | |

Facilities that make Group I lubricant base oils typically use solvents to extract the lower viscosity index (VI) components and increase the VI of the crude to the specifications desired. These solvents are typically phenol or furfural. Solvent extraction gives a product with less than 90% saturates and more than 300 ppm sulfur. The majority of the lubricant production in the world is in the Group I category.

Facilities that make Group II lubricant base oils typically employ hydroprocessing such as hydrocracking or severe hydrotreating to increase the VI of the crude oil to the specification value. The use of hydroprocessing typically increases the saturate content above 90 and reduces the sulfur below 300 ppm. Approximately 10% of the lubricant base oil production in the world is in the Group II category, and about 30% of U.S. production is Group II.

Facilities that make Group III lubricant base oils typically employ wax isomerization technology to make very high VI products. Since the starting feed is waxy vacuum gas oil (VGO) or wax which contains all saturates and little sulfur, the Group III products have saturate contents above 90 and sulfur contents below 300 ppm. Fischer-Tropsch wax is an ideal feed for a wax isomerization process to make Group III lubricant base oils. Only a small fraction of the world's lubricant supply is in the Group III category.

Group IV lubricant base oils are derived by oligomerization of normal alpha olefins and are called poly alpha olefin (PAO) lubricant base oils.

Group V lubricant base oils are all others. This group includes synthetic esters, silicon lubricants, halogenated lubricant base oils and lubricant base oils with VI values below 80. For purposes of this application, Group V lubricant base oils exclude synthetic esters and silicon lubricants. Group V lubricant base oils typically are prepared from petroleum by the same processes used to make Group I and II lubricant base oils, but under less severe conditions.

Synthetic lubricant base oils meet API Interchange Guidelines but are prepared by Fisher-Tropsch synthesis, ethylene oligomerization, normal alpha olefin oligomerization, or oligomerization of olefins boiling below $C_{10}$. For purposes of this application, synthetic lubricant base oils exclude synthetic esters and silicon lubricants.

The present process in using high pressure and high flow rate impingement conditions also allow one to incorporate a catalyst or initiator into the mix. Any suitable catalyst or initiator useful in enhancing the reaction to form the grease thickener can be used. The catalyst or initiator can be introduced into the mixing chamber of the RIM device at the same time as the other grease components. Or, in another embodiment, the catalyst or initiator can be present in at least one of the lube base oil mixtures, e.g., in one or both of the amine/lubricating base oil and cyanate/lubricating base oil mixtures. These initiators or catalysts can enhance the thickener formed with desired physical properties, e.g., the density of the thickener. In one embodiment, the initiator or catalyst comprises active hydrogen components, such as amines, polyols, alcohols, water or other active proton sources.

Additives to enhance the performance of the grease can also be added to the prepared grease after the reaction has been completed. Generally, the additives can be added downstream of the mixing chamber. Any known grease additive can be added depending on the particular property to be enhanced.

The grease prepared by the present process exhibits excellent properties, such as low noise, high temperature resistance and mechanical stability as formed. The homogeneity of the grease is also sufficient that further processing, e.g., post processing such as milling, is often not necessary. The present process provides an excellent grease in a most efficient and effective manner without the need for extensive, or even any post treatment. The present method can be used in a batchwise process, or as part of a continuous process for manufacturing grease.

The following examples help to further illustrate the methods for preparing a grease.

Comparative Example 1

A urea based grease was prepared using a conventional bench top process employing a table top mixer. The grease was prepared as follows:

Amines and di-isocyanates were combined in a 1.4 to 1 weight ratio to a kettle containing a 600 SUS base oil with heating and mixing.

The contents immediately thickened. The mixture was cooked at temperatures of 250° F. to 320° F. for one hour with agitation. Next, the mixture was allowed to cool to 200° F., at which point the mixture was passed through a 3 roll mill. The grease was then cooled overnight to room temperature.

Example 1

In following Comparative Example 1 above, urea grease was synthesized using a RIM device such that the amines and di-isocyanates weight ratio was kept at 1.4 to 1 and was mixed and reacted in the presence of lubricating base oil. Each tank in the RIM unit housed a separate mixture, so that in Tank 1 diisocyanates and oil were present, and in Tank 2 amines and oil were present. The Tank 1 and Tank 2 mixtures were reacted together inside of a mixing chamber of the RIM device at varying shot pressures, 1000 PSI (6.895e+006 newtons/square meter), 1700 PSI (1.172e+007 newtons/square meter), and 2500 PSI (1.724e+007 newtons/square meter), at which a grease was formed and then transferred into a holding container. The entry orifices for each mixture from the tank to the mixing chamber of the RIM device were about 0.014 inch (about 0.03556 centimeter) in diameter.

Results for Comparative Example 1 and Example 1

| Specification | Comparative Example 1 | Example 1 |
|---|---|---|
| Thickener Content % | 12% | 12% |
| Appearance | Light Tan Brown | Light Tan Brown |
| Dropping Point ° F. | 489 (253° C.) | 543 (283° C.) |
| Anderonmeter (Anderons) | 7 | 4 |

Microscope images of the greases were taken, and are shown in FIGS. 1-4. The magnification was taken at 200× with an optical microscope.

Example 2

Urea grease was synthesized using the RIM device used in Example 1 such that the amines and di-isocyanates weight ratio was kept at 1.4 to 1 and was mixed and reacted in the presence of lubricating base oil. Each tank in the RIM unit housed a separate mixture, so that in Tank 1 diisocyanates and oil were present, and in Tank 2 amines and oil were present. The Tank 1 and Tank 2 mixtures were reacted together inside of a mixing chamber of the RIM device at 2500 PSI (1.724e+007 newtons/square meter). Additives were then dispersed into the system and the product was then allowed to cool overnight. Characteristics of the resulting grease are shown below.

Comparative Example 2

A urea based grease was prepared using a conventional kettle batch process employing a pilot scale mixer. The grease was prepared as follows:

Amines and di-isocyanates were combined in a 1.4 to 1 weight ratio to a kettle containing a 600 SUS base oil with heating and mixing.

The contents immediately began to thicken. The mixture was cooked at temperatures of 250° F. (121° C.) to 320° F. (160° C.) for one hour with agitation. Next, the mixture was allowed to cool to 200° F. (93° C.), at which point additives were mixed into the system and then allowed to cool overnight.

Results for Example 2 and Comparative Example 2.

| Specification | Example 2 | Comparative Example 2 |
|---|---|---|
| Thickener Content % | 12.4% | 12.4% |
| Appearance | Brown | Brown |
| Dropping Point ° F. | 503 (261° C.) | 485 (251° C.) |
| P(0) Unworked Penetration | 253 | 214 |
| P(60) Worked Penetration | 278 | 261 |
| P(100,000) Worked Penetration | 334 | 410 |
| Anderonmeter (Anderons) | 2.2 | 2.3 |

One will notice that varying the shot pressures of the RIM process, the microscope pictures are all very similar, they are smooth and very transparent and show no large pieces of thickener material. In contrast, the lab bench top methods show large pieces of thickener components. One advantage is that the RIM process disperses the thickener more effectively than traditional batch methods, and this in turn has advantages in vibration and in noise characteristics. The anderonmeter characteristics indicate superior results in the RIM scenario versus the bench top method. The anderonmeter values show the vibration characteristics of the grease. The low noise grease prepared by the present process generally shows no spikes greater than 4 anderons. Also, the present manufacturing method is more efficient than previous methods for making polyureas.

The RIM produced grease of Example 1 shows a dropping point of 543° F. (283° C.), whereas the dropping point prepared by the batch method was measured at 489° F. (253° C.) in Comparative Example 1. In Example 2, the grease sample that was prepared by the RIM process had a dropping point of 503° F. (261° C.), whereas the analogous system using conventional methods provided a grease with a dropping point of 485° F. (251° C.) in Comparative Example 2. The dropping points of greases prepared by the present process are often greater than 500° F. (260° C.), and in a more specific embodiment greater than 530° F. (276° C.). Dropping point is the temperature at which the grease system loses its first drop of fluid due to heating, and can be used as a general way to determine top operating temperature conditions. The dropping point of a grease is generally measured, for example, by standard test method ASTM D 2265-06.

In addition to the enhanced high temperature resistance of the RIM produced greases, the present process also provides improved mechanical stability characteristics for the grease. Mechanical stability provides information on the ability of the grease sample to withstand changes in consistency during mechanical working. The working of the grease can be accomplished using a variety of techniques. The standard test method ASTM D 217-10 to measure the P(0) unworked, P(60) worked, and P(100,000) worked penetration values has been used. RIM produced Example 2 illustrates the improved mechanical stability when compared to a sample made with conventional techniques in Comparative Example 2. Example 2 softens to 334 penetration points after 100,000 double strokes, a change of 56 penetration points from the P(60) value. In comparison, non RIM produced Comparative Example 2 shows a change of 149 penetration points from its P(60) value, yielding a grease that softens ultimately to 410 on the same mechanical stability test. Thus, Example 2 shows better mechanical stability than Comparative Example 2 as shown by both its final P(100,000) value and its change in penetration value from the P(60) to P(100,000). In general, the present process provides a grease having a P(100,000) value of about 350 penetration points or less. The change in penetration value from the P(60) to P(100,000) value is also generally 100 points or less, and in another embodiment 60 points or less.

Various modifications and alterations of this invention will become apparent to those skilled in the art without departing from the scope and spirit of the invention. Other objects and advantages will become apparent to those skilled in the art from a review of the preceding description.

That which is claimed is:

1. A method for preparing a grease comprising:

a) preparing a first mixture comprised of a first lubricating base oil and at least one amine, and a second mixture comprised of a second lubricating base oil and at least one isocyanate;

b) mixing the first mixture and the second mixture together in a mixing zone under high pressure and high flow rate impingement conditions to thereby have the at least one amine and at least one isocyanate react and have a reaction product dispersed throughout the first and the second lubricating base oils, with each of the first and the second mixture being introduced into a mixing zone through an orifice less than 0.030 inch (0.0762 centimeter) in diameter and with the reaction and dispersion occurring nearly simultaneously to create a grease product; and c) recovering the grease product directly from the mixing zone, wherein the grease product exhibits a dropping point of greater than 500° F. (260° C.) of and a change in penetration value from P(60) to P(100,000) of less than 100 penetration points.

2. The method of claim 1, wherein the orifice is 0.020 inch (0.0508 centimeter) or less in diameter.

3. The method of claim 1, wherein the first and second lubricating base oils are the same.

4. The method of claim 1, wherein the first mixture and the second mixture pass through different orifices.

5. The method of claim 1, wherein the mixing zone is occurs in a reaction injection molding device.

6. The method of claim 1, wherein the high pressure used is in the range of from about 500 to 8000 psi (about 3.447e+006 to 5.516e+007 newtons/square meter).

7. The method of claim 1, wherein a flowrate used is in the range of from about 5 to 1000 g (about 0.1764 to 35.27 ounce)/sec.

8. The method of claim 1, wherein a mixing time is less than 10.0 seconds.

9. The method of claim 8, wherein the mixing time is less than 0.5 second.

10. The method of claim 1, wherein a mixture of amines is used.

11. The method of claim 1 wherein a mixture of isocyanate compounds is used.

12. The method of claim 10, wherein an aryl isocyanate or alkyl isocyanate is used and the mixture of amines includes alkylamines, alkenylamines, alkylenediamine, polyoxyalkylenediamine, cycloalkyleneamines, or cycloalkylamines.

13. The method of claim 12, wherein the aryl isocyanate or alkyl isocyanate are selected from the group consisting of toluene di-isocyanate, methylene diphenyl di-isocyanate, hexane di-isocyanate, phenylene di-isocyanate, bis(diphenyl di-isocyanate), and polyisocyanates, and mixtures thereof, and the amines are selected from the group consisting of butylamine, oleylamine, pentylamine, hexylamine, heptylamine, octylamine, nonylamine, decylamine, dodecylamine, tetradecylamine, hexadecylamine, octadecylamine, dodecenylamine, hexadecenylamine, ethy lenediamine, propy lenediamine, buty lenediamine, hexy lenediamine, dodecylenediamine, octylenediamine, polyoxypropylenediamine, cyclohexanediamine, methylenedianiline, methylaniline, aniline, alkylated aniline, cyclohexylamine, dicyclohexylamine, cyclopentylamine, cycloheptylamine, cycloctylamine, and mixtures thereof.

14. The method of claim 1, wherein the grease product recovered in step c) comprises at least 20% by weight of a urea thickener prepared as the reaction product.

15. The method of claim 14, wherein the method further comprises adding additional lubricating base oil to the grease product of step c) to prepare a grease product comprising about 12% by weight of the urea thickener.

16. The method of claim 1, wherein a catalyst or initiator is present when the first mixture and the second mixture are mixed together.

17. The method of claim 1, further comprising adding physical property enhancing additives to the grease product of step c).

18. A method for preparing a grease comprising:

a) preparing a first mixture comprised of a first lubricating base oil and at least one amine, and a second mixture comprised of a second lubricating base oil and at least one isocyanate;

b) mixing the first mixture and the second mixture together in a mixing zone under high pressure in the range of from about 1000 to 8000 psi and high flow rate impingement conditions to thereby have the at least one amine and at least one isocyanate react and have a reaction product dispersed throughout the first and the second lubricating base oils, with each of the first and the second mixture being introduced into a mixing zone through an orifice less than 0.030 inch (0.0762 centimeter) in diameter and with the reaction and dispersion occurring nearly simultaneously to create a grease product; and c) recovering the grease product directly from the mixing zone, wherein the grease product exhibits a dropping point of greater than 500° F. (260° C.), a P(100,000) value of about 350 penetration points or less, and a change in penetration value from P(60) to P(100,000) of less than 100 penetration points.

* * * * *